US006113432A

United States Patent [19]

Liao

[11] Patent Number: 6,113,432

[45] Date of Patent: Sep. 5, 2000

[54] MOVABLE CONNECTING SEAT OF A TELEPHONE WIRE

[75] Inventor: Sheng Hsin Liao, Taipei Hsien, Taiwan

[73] Assignee: Polymax Precision Industrial Co., Ltd.

[21] Appl. No.: 09/277,818

[22] Filed: Mar. 29, 1999

[30] Foreign Application Priority Data

Jul. 10, 1998 [TW] Taiwan ..... 87211147

[51] Int. Cl.[7] ..... H01R 25/00

[52] U.S. Cl. ..... 439/638; 439/676

[58] Field of Search ..... 439/638, 654, 439/521, 628, 676, 334, 135

[56] References Cited

U.S. PATENT DOCUMENTS

| | | | |
|---|---|---|---|
| 4,290,664 | 9/1981 | Davis et al. | 439/638 |
| 5,632,656 | 5/1997 | Lo | 439/676 |
| 5,639,262 | 6/1997 | Lim | 439/607 |

*Primary Examiner*—Khiem Nguyen
*Assistant Examiner*—Son V. Nguyen
*Attorney, Agent, or Firm*—Rosenberg, Klein & Lee

[57] ABSTRACT

A movable connecting seat assembly for coupling together a pair of telephone wire plugs is provided. The assembly includes a movable upper cover displacably coupled to a seat. When not in use, the upper cover may be disposed in a closed position over the seat. By the engagement of convex point protrusions and corresponding slots, the upper cover is releasably locked in the closed position relative to the seat, yielding a compact structure. The assembly may then be conveniently stored or carried. During use, the upper cover is pulled upward relative to the seat. The upper cover is formed with a plurality of hook portions which respectively engage a plurality of buckling holes formed in the seat in such manner that the upper cover may be displaced relative to the seat between the opened and closed positions. The upper cover is formed with a fixing pillar which slidably engages a corresponding fixing groove cavity formed in the seat to prevent the upper cover's tilting as it displaces between such opened and closed positions. When the upper cover is disposed at the open position, the pair of telephone wire plugs may be received in opposed manner between the upper cover and seat.

7 Claims, 6 Drawing Sheets

MOVABLE CONNECTING SEAT OF A TELEPHONE WIRE

FIELD OF THE INVENTION

The present invention relates to a movable connecting seat of a telephone wire, and especially to a connecting seat for connecting two telephone wires. Thereby, the joints of two telephone wires are connected rapidly.

BACKGROUND OF THE INVENTION

Since the communication has been improved more and more rapidly. Data processing and speech communication are required for every people in daily life. However, in wire communication it is necessary to connect telephone wires. In the prior art, the telephone wires are connected by a wire box with a hollow container. Two ends of the wire box are installed with respective joint seats for installing with joints of telephone wires in order to connect joints of telephone wires. However, the prior art wire box has a large volume and a complex structure. It is very inconvenient in using.

SUMMARY OF THE INVENTION

Accordingly the primary object of the present invention is to provide a movable connecting seat of a telephone wire which has a movable upper cover and has a simply structure so as to reduce the volume of the connecting seat properly. Thus, the present invention can be carried easily and conveniently and has a lower cost.

Another object of the present invention is to provide a movable connecting seat of a telephone wire for connecting two telephone wires in order to achieve the object of telephone communication.

The various objects and advantages of the present invention will be more readily understood from the following detailed description when read in conjunction with the appended drawing.

DETAILED DESCRIPTION OF THE PREFERRED EMBODIMENTS

Figure 1:
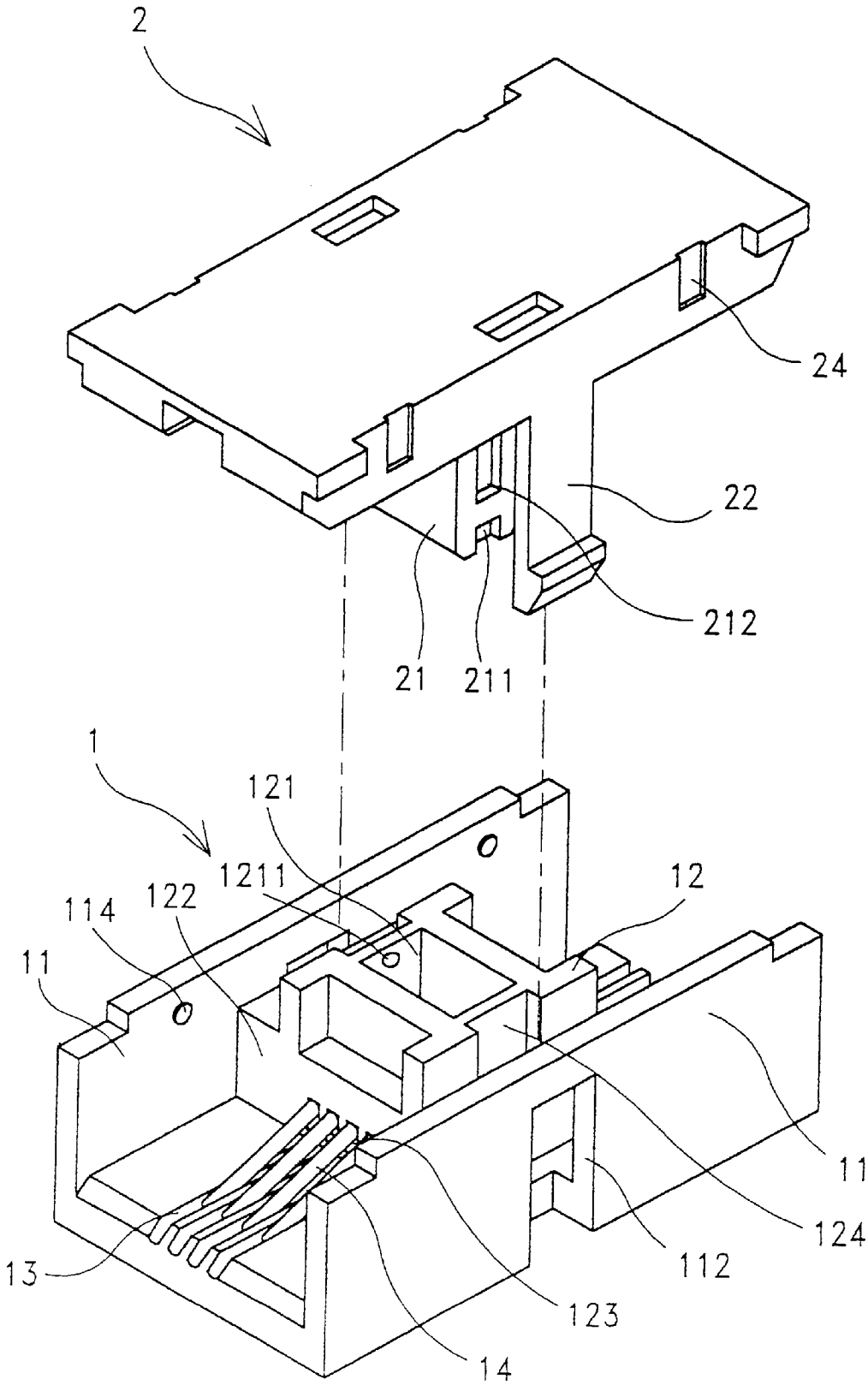
FIG. 1 is an exploded perspective view of the present invention.
Figure 4:
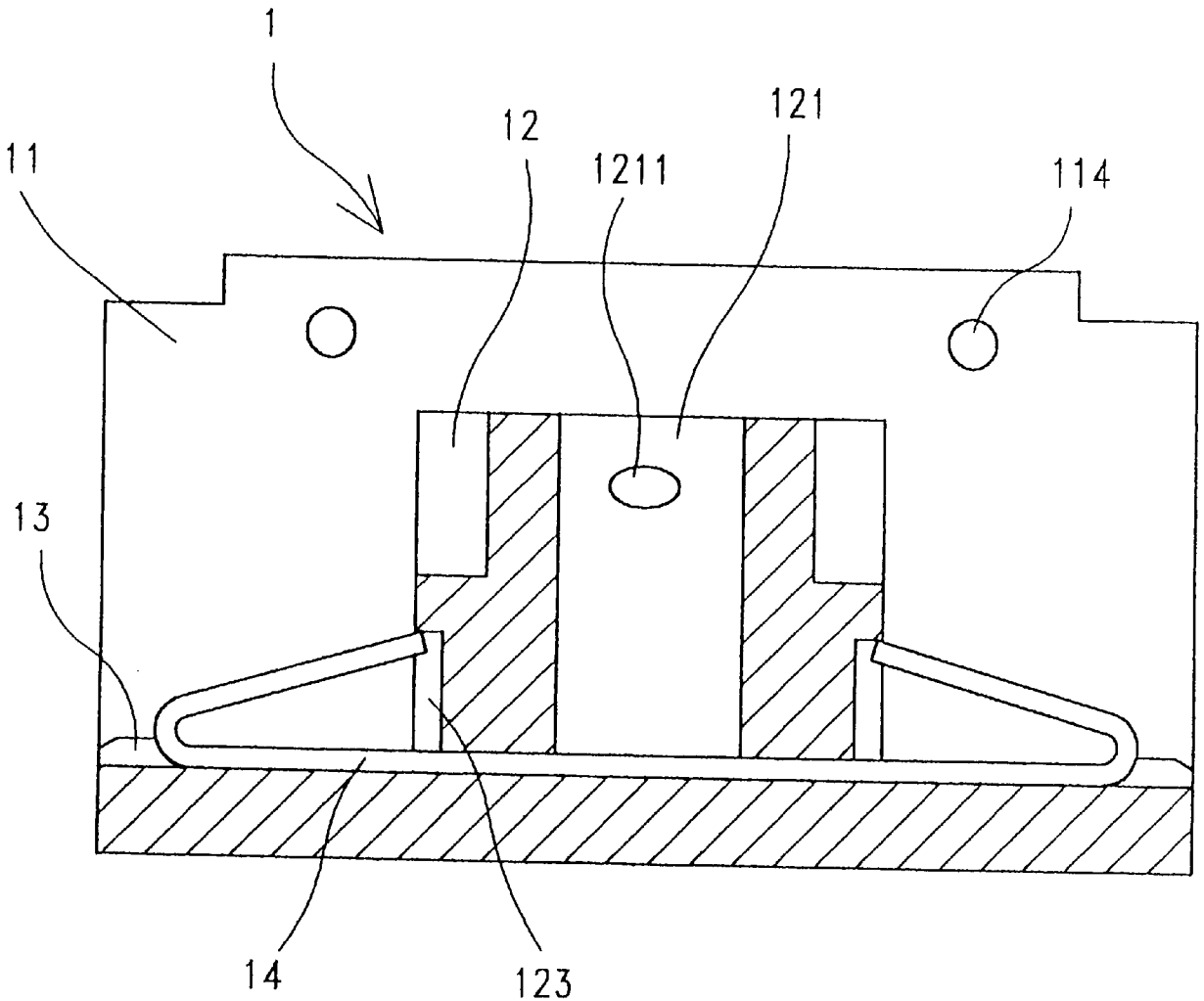
FIG. 4 is a schematic cross sectional view showing the bottom of the present invention.

With reference to FIG. 1, a perspective view of the present invention is illustrated. As shown in the figure, the present invention is primarily installed with a seat 1. Two sides of the seat 1 are installed with respect lateral sides 11 so that the seat 1 is formed with a U shape structure. A block 12 is formed at the center of the seat 1, A fixing groove 121 is formed on the center of the block 12. Each of the two lateral walls within the fixing groove 121 is installed with a convex point 1211. Further, a plurality of parallel guiding grooves 13 are installed on the inner bottom of the seat 1 along two end surfaces, as shown in FIG. 4. The grooves 13 also pass through the bottom of the block 12 in a respective place. Each of the grooves 13 is inserted by a metal conducting wire 14 so that the metal conducting wire is installed within the guiding groove 13. Two ends of the metal conducting wire 14 are bent upwards with a proper angle. The end of the metal conducting wire 14 is received within an upper sliding groove 123 installed at the block 12. The sliding groove 123 is installed at the lateral wall 122 of the block 12 with respect to the guiding groove 13. Moreover, an inserting groove 124 is installed on the center between the block 12 and the lateral edge 11. A rectangular buckling hole 112 is installed on the lateral edge 11. A plurality of convex points 114 is formed in a proper place at the inner wall of the two lateral edge 11.

Figure 2:
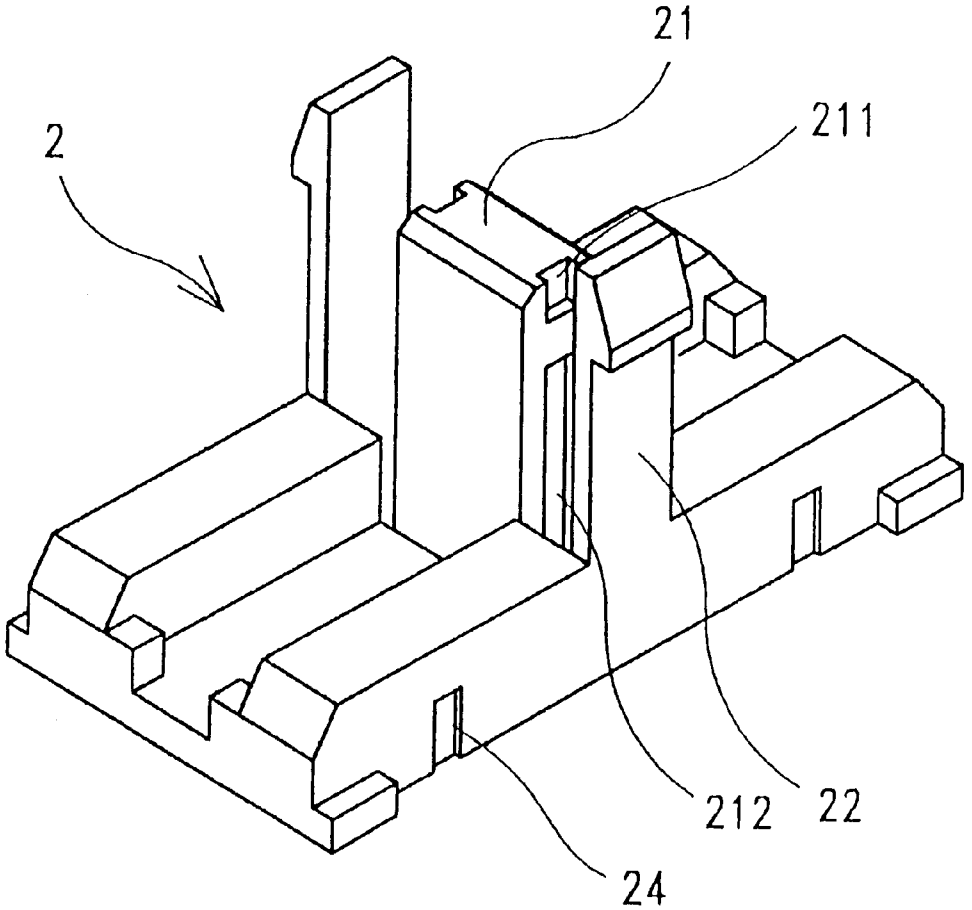
FIG. 2 is another perspective view of the upper cover according to the present invention.
Figure 3:
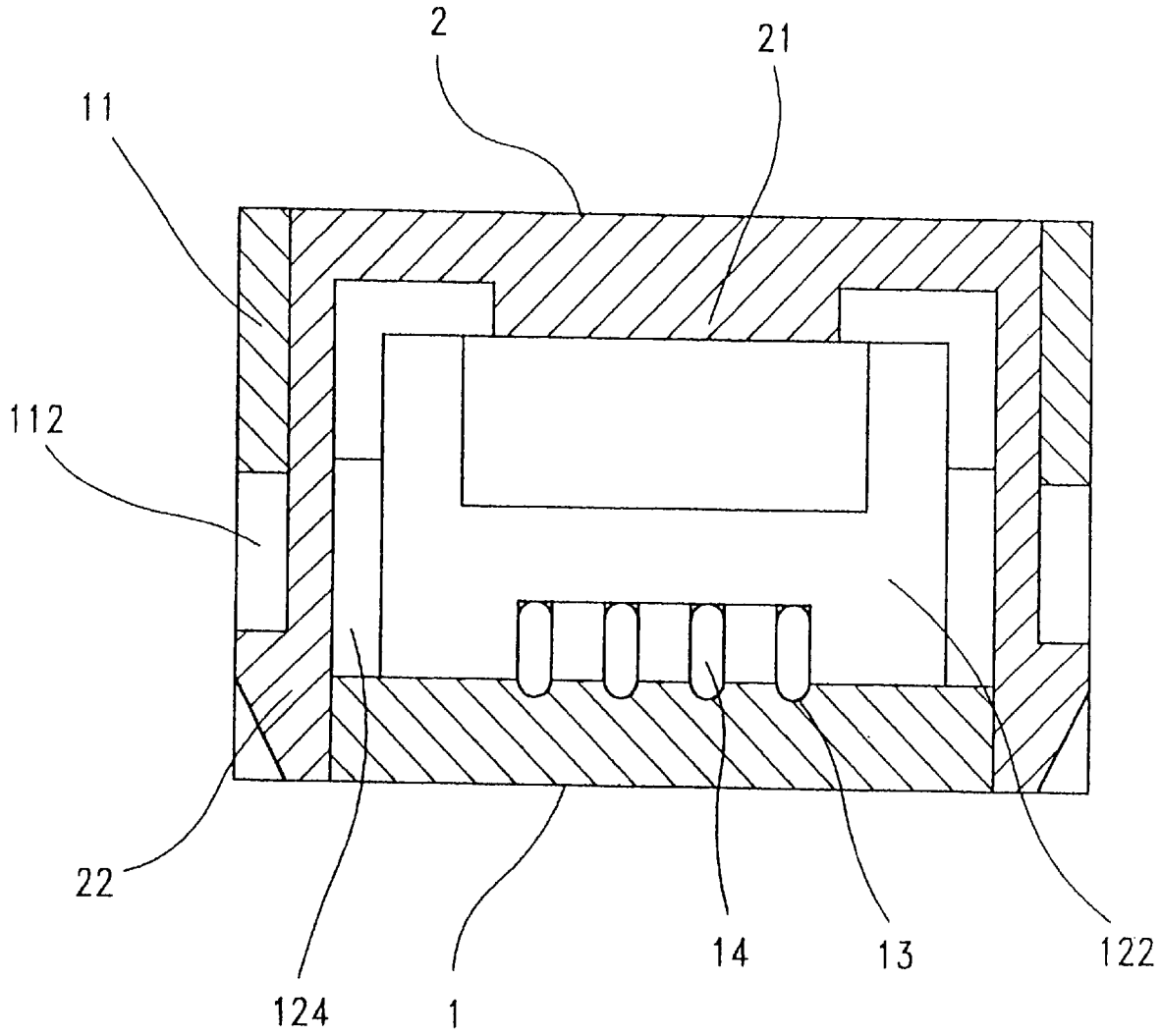
FIG. 3 is a cross sectional view showing that the present invention has been covered.

Referring to FIG. 2, another schematic perspective view of the upper cover according to the present invention is illustrated. The present invention is installed with an upper cover 2, and a pillar 21 is installed on the center of the bottom of the upper cover 2. The pillar 21 can be inserted into the fixing groove 121. In order to match with the convex point 1211, a groove 211 and a sliding groove 212 are installed on the two lateral surfaces of the pillar 21 with respect to the longitudinal position of the convex point 1211 so that the convex point 1211 can be buckled in the groove 211 and can slide within the sliding groove 212. Two lateral sides of the upper cover 2 with respect to the inserting groove 124 are formed with respective downward hook portions 22. The hook portion 22 may be inserted into the inserting groove 124 and then is buckled within the buckling hole 112 so that the hook portion 22 moves upwards and downwards within the buckling hole 112, as shown in FIG. 3. Furthermore, a slot 24 with respect to the convex point 114 is formed on lateral side of upper cover 2. Thus, when the upper cover covers the seat 1. By buckling convex point 114 to the slot 24, the upper cover 2 is firmly secured to the seat 1.

Figure 5:
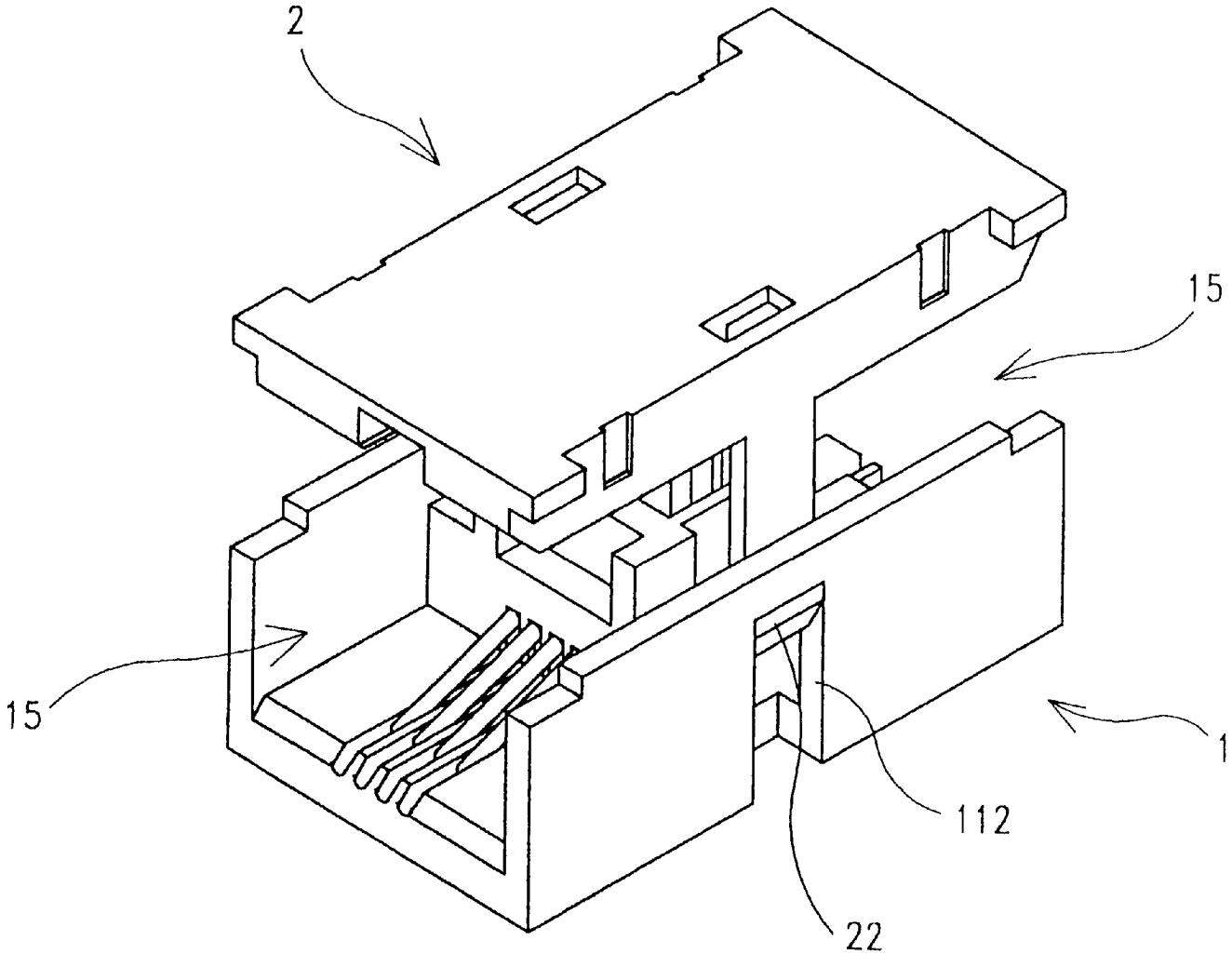
FIG. 5 is a schematic perspective view showing that the upper cover is opened from the seat.
Figure 6:
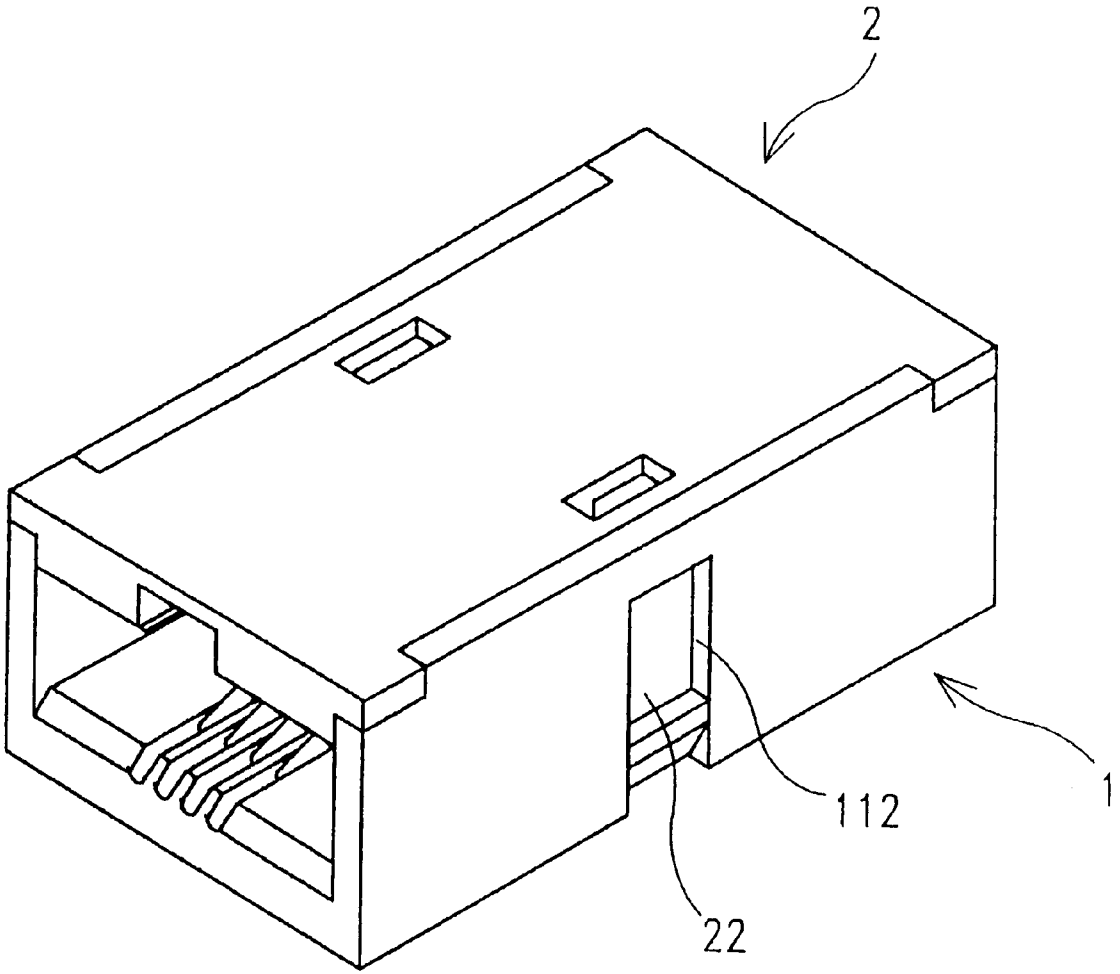
FIG. 6 is a schematic perspective view showing that the upper cover covers the seal.

When the present invention is not used, the upper cover 2 covers the seat 1, and by matching the convex point 114 to the slot 24, the upper cover 2 is prevented to slide to separate with the seat 1. Thus, the whole volume is reduced so as to be conveniently stored and carried, as shown in FIG. 6. When the present invention is used, the upper cover 2 is pulled from the seat 1, then, the upper cover 2 is confined to move upwards and downwards by buckling the hook portion 22 to the buckling hole 112, as that shown in FIG. 5. By matching the pillar 21 to the groove 121, the upper cover 2 is prevented to tilt when it moves upwards and downwards. When the upper cover moves to a highest position, the convex point 1211 will be buckled in the groove 211 so that the upper cover 2 is fixed in a highest point and then will not slide downwards. Therefore, the joints of telephone wires are inserted in the openings 15 of two end faces of the seat 1.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

Description of the Numerals in Figures

| | | | |
|---|---|---|---|
| 1 | upper cover | 11 | Lateral side |
| 112 | Buckling hole | 114 | convex point |
| 12 | block | 121 | Fixing groove |
| 1211 | convex point | 122 | Lateral wall |
| 123 | Sliding groove | 124 | Inserting groove |
| 13 | Guiding groove | 14 | metal conducting wire |
| 15 | Opening | 2 | upper cover |
| 21 | Pillar | 211 | groove |
| 212 | Sliding groove | 22 | Hook portion |
| 24 | Buckling groove | | |

What is claimed is:

1. A connecting seat assembly for operably coupling together a pair of telephone wire plugs comprising:

(a) a substantially U-shaped seat including:

(1) a longitudinally extended first base portion having formed therein a plurality of longitudinally extending guiding grooves;

(2) a pair of spaced lateral side portions extending transversely from said first base portion, each said lateral side portion having formed therein an elongate buckling hole;

(3) a block coupled to said first base portion, said block having formed therein a plurality of transversely extending sliding grooves each substantially aligned with at least a portion of one said guiding groove, said block having formed therein a pair of inserting grooves respectively opposing said lateral side portions; and, (4) a plurality of conducting wire members each received in one said guiding groove, each said conducting wire member engaging at least one said sliding groove of said block; and, (b) a cover displacably coupled to said seat for displacement relative thereto between open and closed positions, said cover including:

(1) a longitudinally extended second base portion; and, (2) a pair of hook portions extending transversely from said second base portion, said hook portions respectively engaging said buckling holes of said lateral side portions of said seat, said hook portions being displaceable within said respective buckling holes;

whereby said seat and cover are adapted to receive the pair of telephone wire plugs concurrently therebetween when said cover is disposed in said open position.

2. The connecting seat assembly as recited in claim 1 wherein said block includes a pair of longitudinal opposed wall surfaces, each said wall surface having a plurality of said upwardly extending sliding grooves formed therein.

3. The connecting seat assembly as recited in claim 2 wherein at least one said conducting wire member is formed with a bent configuration at longitudinally opposed ends thereof for respectively engaging at least one said sliding groove of each said block wall surface.

4. The connecting seat assembly as recited in claim 3 wherein said block of said seat has formed therein a fixing groove cavity, and said cover includes a pillar portion projecting from said second block portion, said pillar portion slidably engaging said fixing groove cavity for substantially guiding the stable displacement of said cover relative to said seat.

5. The connecting seat assembly as recited in claim 3 wherein each of said lateral side portions of said seat has formed thereon a plurality of convex point protrusions for lockingly engaging said cover when said cover is disposed in said closed position.

6. The connecting seat assembly as recited in claim 3 wherein said block of said seat has formed thereon a plurality of convex point protrusions protruding into said fixing groove cavity, said convex point protrusions engaging said pillar portion of said cover in releasably locked manner when said cover is disposed in said open position.

7. The connecting seat assembly as recited in claim 6 wherein said pillar portion of said cover has formed therein a plurality of sliding groove slots for respectively receiving in slidable manner therein said convex point protrusions of said block during the displacement of said cover between said open and closed positions thereof.

* * * * *